US005615697A

United States Patent [19]

Lin et al.

[11] Patent Number: 5,615,697

[45] Date of Patent: Apr. 1, 1997

[54] POCKETABLE FOLDING UMBRELLA WITH FOLDABLY SANDWICHED RIBS

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 662,466

[22] Filed: Jun. 10, 1996

[51] Int. Cl.[6] ..... A45B 11/00

[52] U.S. Cl. ..... 135/20.1; 135/25.1; 135/28; 135/37

[58] Field of Search ..... 135/20.1, 25.1, 135/25.4, 28, 37, 42

[56] References Cited

U.S. PATENT DOCUMENTS 3,837,352 9/1974 Weber ..... 135/20.1 X
4,474,200 10/1984 Kida .
5,263,505 11/1993 Yeom ..... 135/28 X
5,355,903 10/1994 Haddad et al. .
5,533,535 7/1996 Lin et al. ..... 135/25.1 X

*Primary Examiner*—Lanna Mai

[57] ABSTRACT

A pocketable folding umbrella Includes: a slim upper notch secured on an upper portion of a central shaft; a slim lower runner slidably held on the central shaft; two extremity rib sets respectively pivotally secured to two extremity portions of the upper notch and the lower runner; four flat-side rib sets respectively pivotally secured to two flat-side portions of the upper notch and the lower runner; an umbrella cloth secured on the rib sets; a plurality of folding springs each secured on the rib set for resiliently retracting the rib sets for minimizing a folding volume of the rib sets: and a narrowing member formed or secured to the upper notch and having a pair of U-shaped recesses disposed on two opposite end portions of the narrowing member for guiding the rib sets as being folded from an opening umbrella and storing the folded rib sets within the two U-shaped recesses for greatly minimizing the folding volume for forming a miniature slim pocketable foldable umbrella,

9 Claims, 7 Drawing Sheets

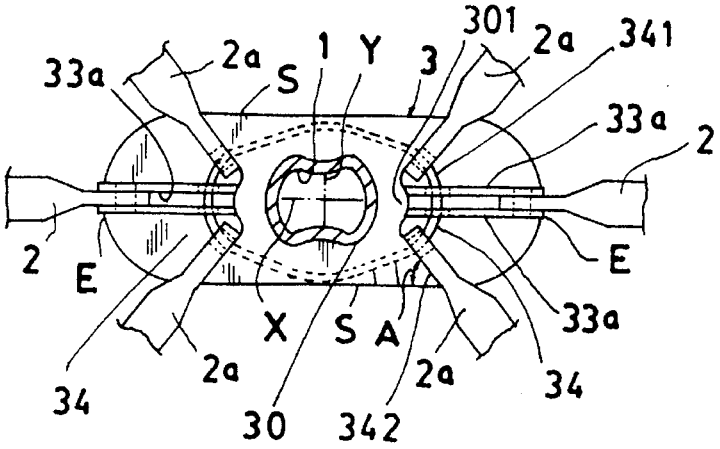
FIG. 4
FIG. 5
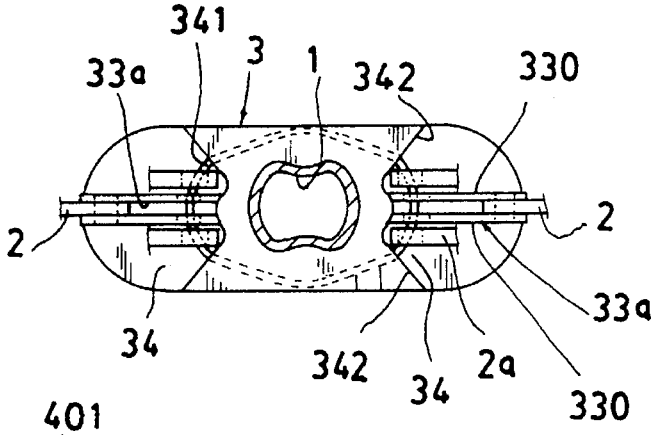
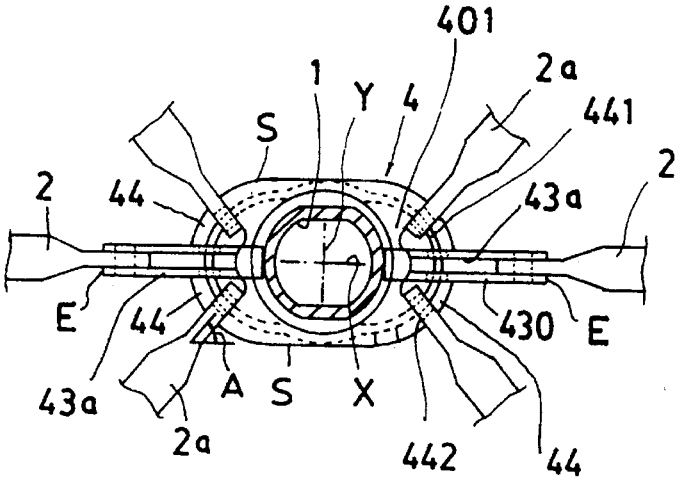
FIG. 6
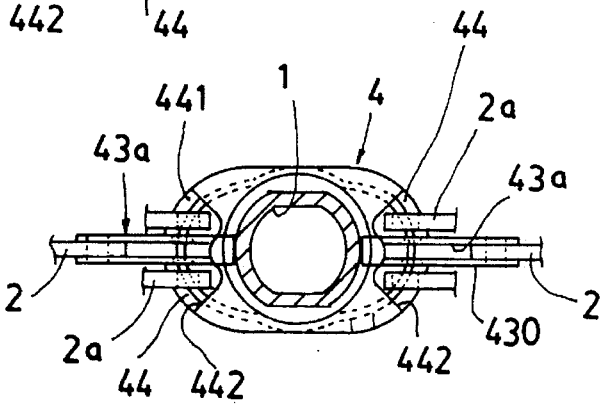
FIG. 7

FIG. 8
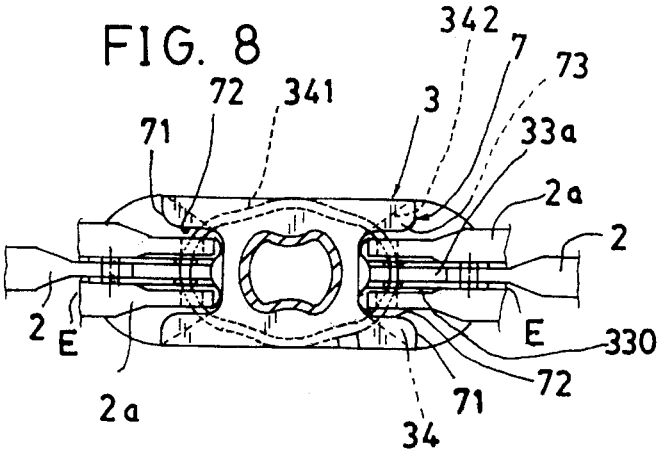
FIG. 9
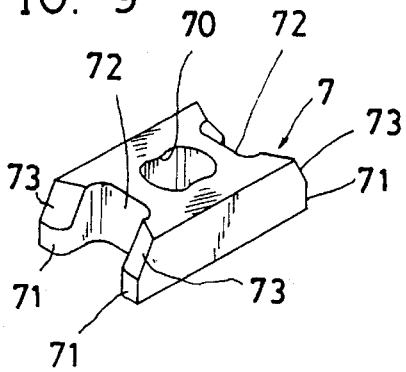
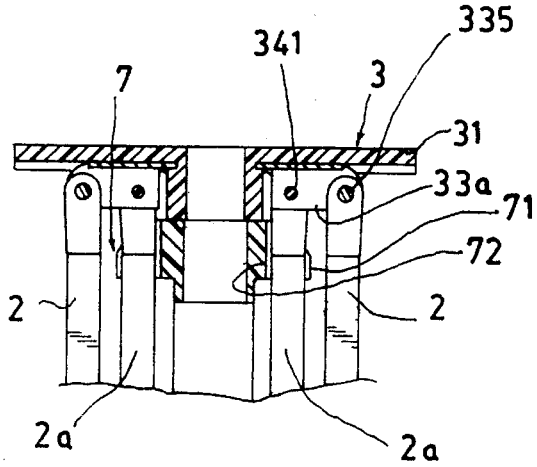
FIG. 10
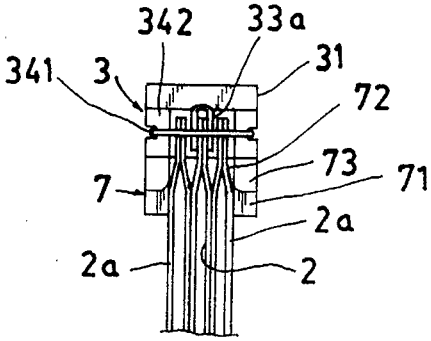
FIG. 11
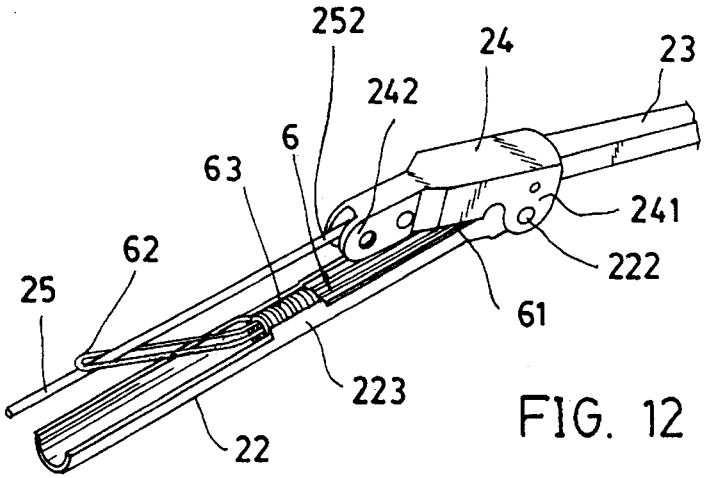
FIG. 12

POCKETABLE FOLDING UMBRELLA WITH FOLDABLY SANDWICHED RIBS

BACKGROUND OF THE INVENTION

This invention is an improvement of the prior arts of the U.S. patent applications, namely U.S. Ser. No. 08/439,509, filed on: May 11, 1995; and U.S. Ser. No. 08/600,070, filed on: Feb. 12, 1996, which were also invented by the same inventors of this invention.

However, the prior arts of the earlier U.S. patent applications have the following drawbacks:

1. Whenever folding the umbrella rib assembly from an opening state to approximate the upper notch 3 and lower runner 4, it still requires a manual operation to bias the flat-side rib means 2*a* towards the extremity rib means 2 in order to minimize the folding volume of the rib assembly and the umbrella cloth 5, thereby causing inconvenience for the umbrella user.

2. Either the upper slim plate 31 or the lower slim plate 41 of U.S. Ser. No. 08/439,509 is slimly elongated to form each pair of pivoting means 33, 43 disposed on two opposite end portions of each slim plate 31, 41, thereby weakening the strength and easily breaking the slim parts when subjected to tension force of an opening umbrella. The gradational structure of U.S. Ser. No. 08/600,070 has thickened the upper notch and lower runner for enhancing the strength, still requiring skillful work for assembling the rib means on the "two-story" upper notch or lower runner.

3. Each pivoting means 33, 43 is generally formed as a semicircular shape to still occupy a big volume of the folded umbrella, thereby influencing a miniaturization of the pocketable umbrella.

The present inventors have found the drawbacks of the prior arts and invented the present pocketable folding umbrella.

SUMMARY OF THE INVENTION

The object of the present invention is to provide a pocketable folding umbrella including: a slim upper notch secured on an upper portion of a central shaft; a slim lower runner slidably held on the central shaft; two extremity rib sets respectively pivotally secured to two extremity portions of the upper notch and the lower runner; four flat-side rib sets respectively pivotally secured to two flat-side portions of the upper notch and the lower runner; an umbrella cloth secured on the rib sets; a plurality of folding springs each secured on the rib set for resiliently retracting the rib sets for minimizing a folding volume of the rib sets; and a narrowing member formed or secured to the upper notch and having a pair of U-shaped recesses disposed on two opposite end portions of the narrowing member for guiding the rib sets as being folded from an opening umbrella and storing the folded rib sets within the two U-shaped recesses for greatly narrowing and minimizing the folding volume for forming a miniature slim pocketable foldable umbrella.

BRIEF DESCRIPTION OF THE DRAWINGS

FIG. 4 is a bottom view of the upper notch of an opened umbrella in accordance with the present invention.

FIG. 5 is a bottom view of the upper notch of the present invention when folded.

FIG. 6 is a top view of the lower runner of an opened umbrella according to the present invention.

FIG. 7 is a top view of the lower runner when folded.

FIG. 8 is a bottom view of the narrowing member of the present invention when folded.

FIG. 9 is a perspective view of the narrowing member of the present invention.

FIG. 10 is a longitudinal sectional drawing of FIG. 8.

FIG. 11 is a side view of the folded narrowing member of the present invention.

FIG. 12 is a perspective illustration showing a relationship between the rib means and the folding umbrella of the present invention.

DETAILED DESCRIPTION

Figure 1:
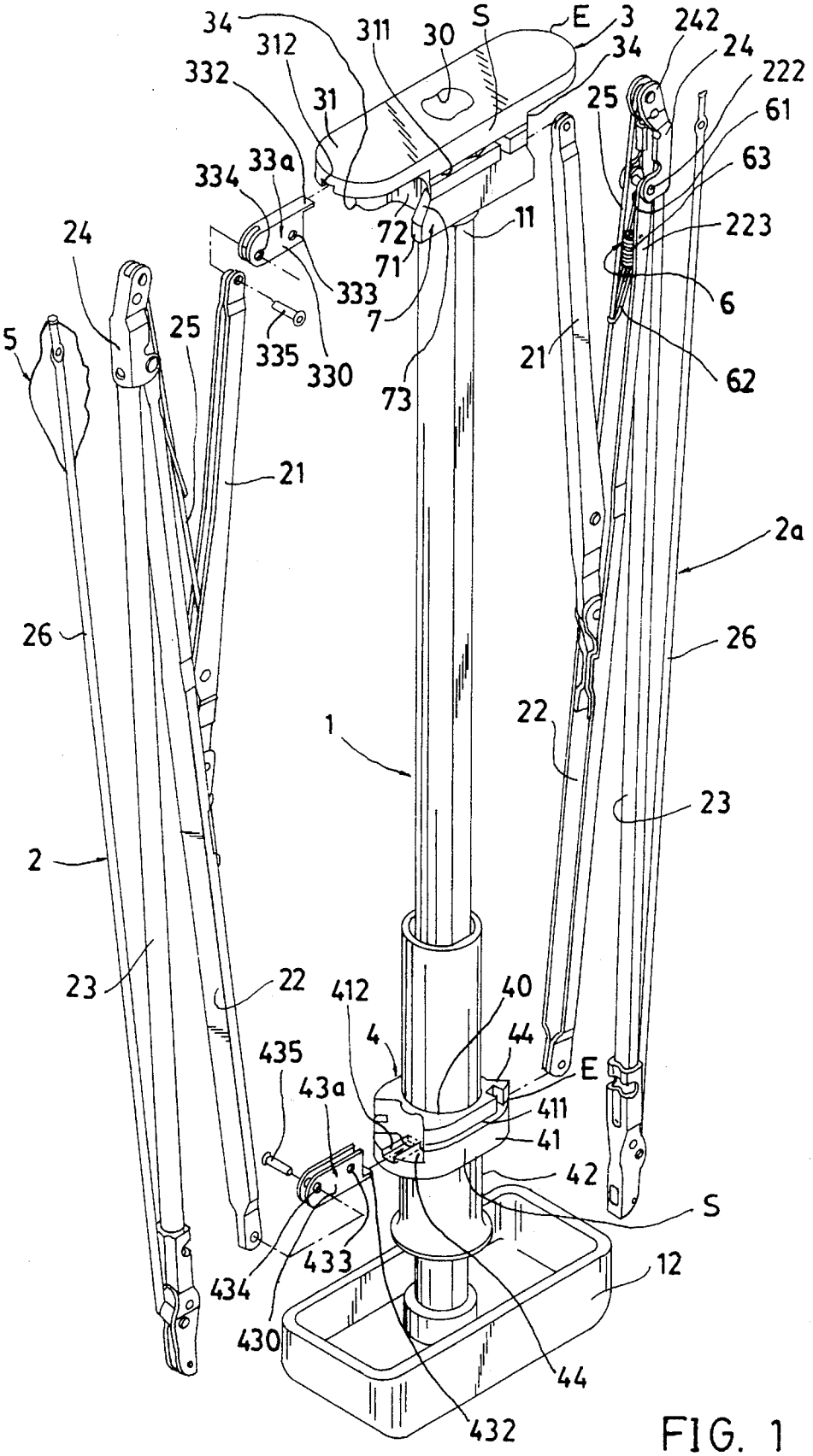
FIG. 1 is a perspective view showing the elements of the present invention.

As shown in FIGS. 1–12, the present invention comprises: a central shaft 1 comprised of at least an inner tube and an outer tube telescopically coupled with each other, and having a grip portion 12 formed on a lower portion of the shaft 1; an upper notch 3 secured on an upper portion 11 of the central shaft 1; a lower runner 4 slidably held on the shaft 1 and positioned under the upper notch 3; a rib assembly consisting of two sets of extremity rib means 2 each pivotally secured to an extremity portion E of the upper notch 3 and the lower runner 4 with a pair of the extremity portions E disposed on two opposite end portions of a long axis X of either the upper notch 3 or the lower runner 4, and four sets of flat-side rib means 2*a* each universally pivotally secured to a flat side portion S of the upper notch 3 and the lower runner 4 with a pair of the flat side portions S disposed on two opposite side portions of a short axis Y of either the upper notch 3 or the lower runner 4; an umbrella cloth 5 secured to the rib means 2, 2*a*; a plurality of folding springs 6 each spring secured on a parallelogram linkage P of the rib means 2, 2*a* for resiliently folding the rib means, when closing the umbrella from an opened state, for minimizing the folding volume; and a narrowing member 7 secured or formed on a bottom of the upper notch 3 for guiding the rib means 2, 2*a* in order for obtaining a minimum folding volume after closing the umbrella.

The upper notch 3 includes: an upper slim plate 31 defining a long axis X between two extremity portions E disposed on two opposite ends of the slim plate 31 and a short axis Y between two flat side portions S of the slim plate 31 to be perpendicular to the long axis X, a central hole 30 formed in a central portion of the slim plate 31 to be engaged with an upper portion 11 of the central shaft 1 for securing the upper notch 3 on the upper portion 11 of the central shaft 1, two pivoting means 33*a* embedded, secured or connected on two opposite extremity portions E of the slim plate 31 for radially pivotally securing a top rib 21 of each extremity rib means 2, and four biasing means 34 each formed on the upper slim plate 31 between each flat side portion S and each pivoting means 33*a* to be disposed around the central hole 30 for universally pivotally securing a top rib 21 of each flat-side rib means 2*a*. The upper slim plate 31 may be connected or integrally formed with the narrowing member 7 positioned below the upper slim plate 31.

Each biasing means 34 includes: a pivot 341 formed as a loop wound in an annular groove 311 recessed in the upper slim plate 31 for universally pivotally securing a top rib 21 of each extremity rib means 2, and an outer retarding portion 342 protruding sidewardly from a central portion 301 of the upper slim plate 31 towards the flat side portion S to define an angle A between the flat side portion S and the outer retarding portion 342 for limiting a flat-side rib means 2*a* when opening the umbrella as shown in FIG. 4, with the flat-side rib means 2*a* operatively biased and retracted by the narrowing member 7 to be generally parallel to a vertical side wall 330 of the pivoting means 33*a* for minimizing a folding volume of a closed umbrella as shown in FIG. 5.

Therefore, each extremity rib means 2 will be sandwiched in between the two flat-side rib means 2*a* to greatly minimize a folding volume of the folded umbrella.

Each biasing means 34 may be modified to be any universally pivoting mechanism, not limited to be a loop type pivot 341 as above-mentioned.

Figures 2, 3:
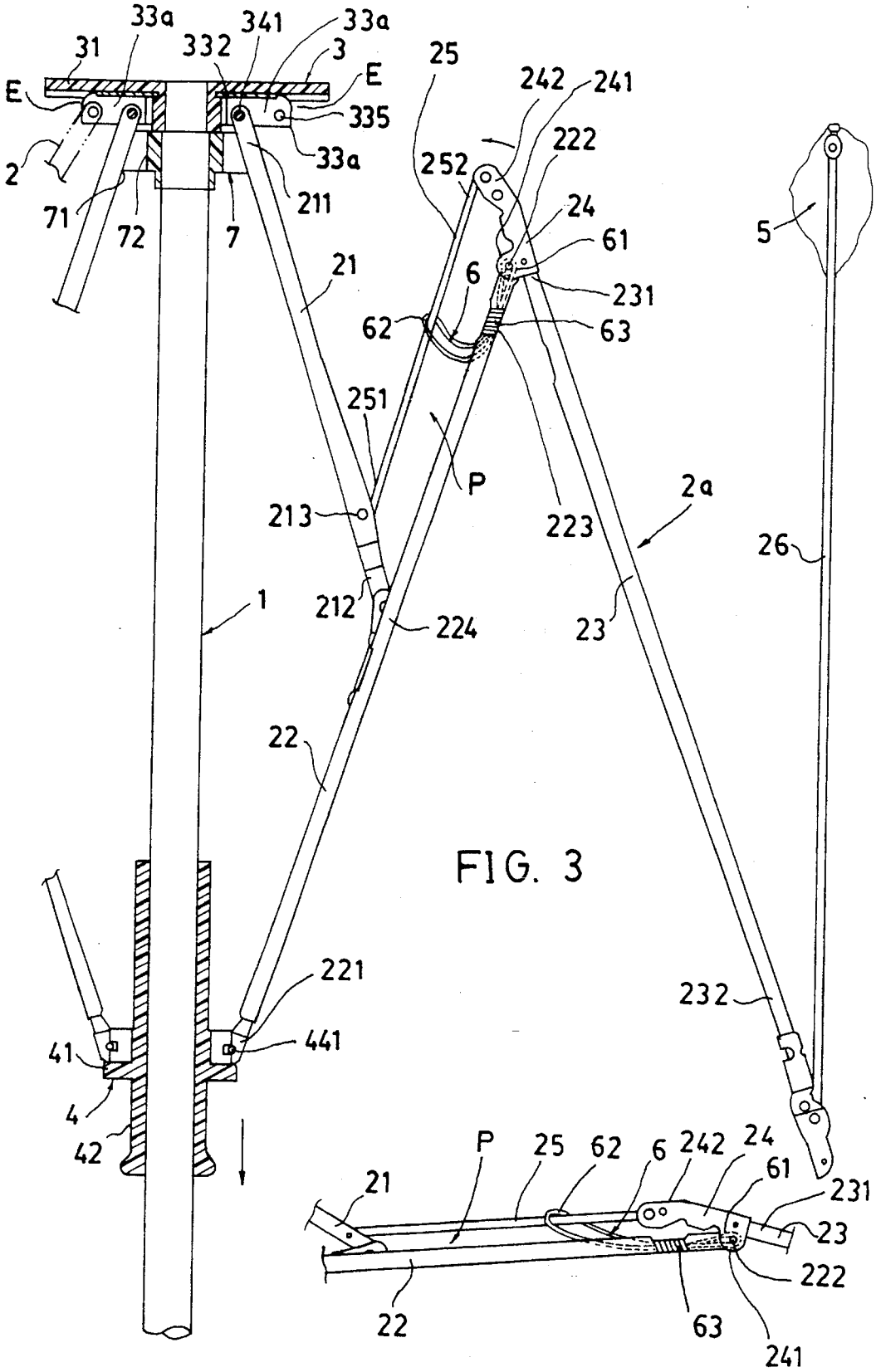
FIG. 2 is an illustration showing the relationship of a parallelogram linkage of the ribs and the folding spring in accordance with the present invention.
FIG. 3 shows an umbrella as being folded and resiliently urged by the folding spring of the present invention.
Figure 3A:
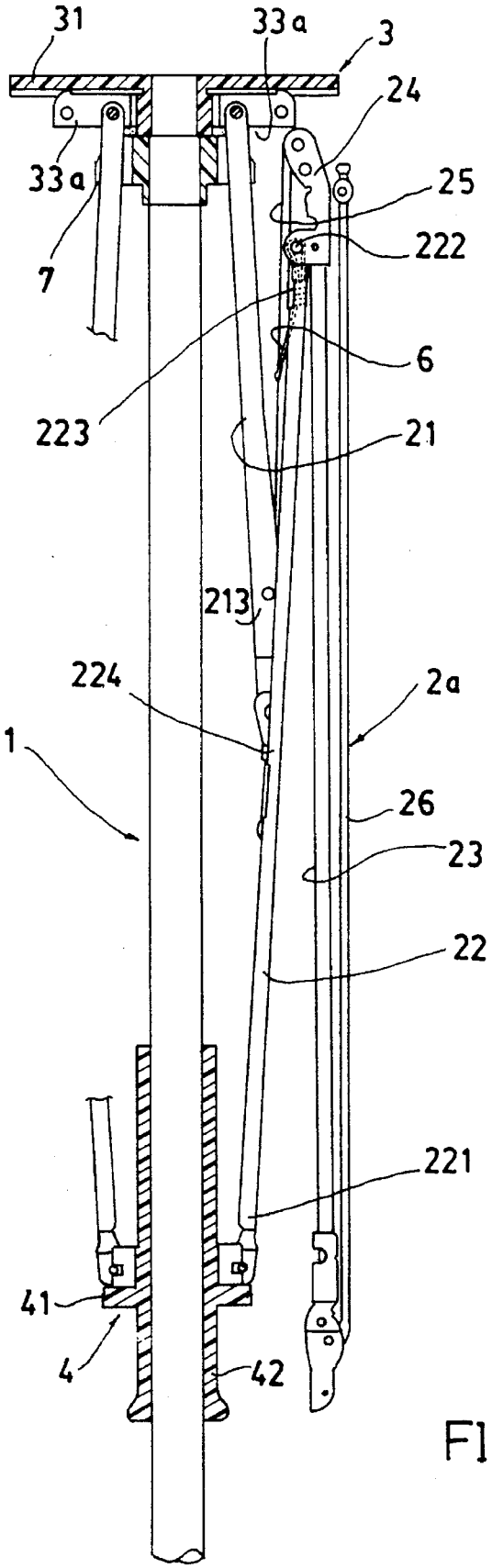
FIG. 3A shows a folded umbrella in accordance with the present invention.

Each pivot means 33*a* especially as shown in FIGS. 1, 3 may be formed as a cassette member embedded in the upper notch 31 and may be made of metals, reinforced plastic or composite materials having good mechanical strength by molding, casting or other processes, which are not limited in the present invention.

Each pivoting means 33*a* formed as a cassette member includes: an extension portion 332 formed on a bottom portion of the pivoting means 33*a* to be engaged with a groove 312 recessed in the upper slim plate 31 of the upper notch 3, an inner pivot hole 333 formed in an inner portion of the pivoting means 33*a* for passing a pivot 341 of the biasing means 34 for fastening the pivoting means 33*a* on the upper notch 3, an outer pivot hole 334 formed in an outer portion of the pivoting means 33*a* for inserting an outer pivot 335 through the outer pivot hole 334 for pivotally securing the extremity rib means 2, and a pair of vertical side walls 330 parallelly formed on two opposite side surfaces of the pivoting means 33*a* for retarding two flat-side rib means 2*a* when folded as shown in FIG. 5.

The pivoting means 33*a* may be pre-fixed in a molding mold when making the upper notch 3 whereby upon a molding processing such as by a plastic molding process, the pivoting means 33*a* will be integrally formed in situ with the upper notch 3 for saving the embedding or other joining procedures for further mounting the pivoting means 33*a* on the upper notch 3.

The lower runner 4 as shown in FIGS. 1, 6 and 7 includes: a sleeve 42 having a central sleeve hole 40 slidably engageable with the central shaft 1, a lower slim plate 41 defining a long axis X between two extremity portions E disposed on two opposite ends of the lower slim plate 41 and a short axis Y between two flat side portions S of the lower slim plate 41 to be perpendicular to the long axis X, a central through hole 40 formed in a central portion of the slim plate 41 to be slidably engageable with the central shaft 1, two runner pivoting means 43*a* embedded, secured or connected on two opposite extremity portions E of the lower slim plate 41 for radially pivotally securing a stretcher rib 22 of each extremity rib means 2, and four runner biasing means 44 each formed on the lower slim plate 41 between each flat side portion S and each pivoting means 43*a* to be disposed around the central hole 40 for universally pivotally securing the stretcher rib 22 of each flat-side rib means 2*a*.

Each runner biasing means 44 includes: a pivot 441 formed as a loop wound in an annular groove 411 recessed in the lower slim plate 41 for universally pivotally securing a stretcher rib 22 of each extremity rib means 2, and an outer retarding portion 442 protruding sidewardly from a central portion 401 of the lower slim plate 41 towards the flat side portion S to define an angle A between the flat side portion S and the outer retarding portion 442 for limiting a flat-side rib means 2*a* when opening the umbrella as shown in FIG. 6, with the flat-side rib means 2*a* operatively biased and retracted by the narrowing member 7 adjacent to the upper notch S to be generally parallel to a vertical side wall 430 of the pivoting means 43*a* for minimizing a folding volume of a closed umbrella as shown in FIG. 7.

Other universal pivoting mechanisms may be modified for substituting the runner biasing means 44 as aforementioned.

Each runner pivoting means 43*a* formed as a cassette member includes: an extension portion 432 formed on a bottom portion of the runner pivoting means 43*a* to be engaged with a groove 412 recessed in the lower slim plate 41 of the lower runner 4, an inner pivot hole 433 formed in an inner portion of the runner pivoting means 43*a* for passing a pivot 441 of the runner biasing means 44 for fastening the runner pivoting means 43*a* on the lower runner 4, an outer pivot hole 434 formed in an outer portion of the runner pivoting means 43*a* for inserting an outer pivot 435 through the outer pivot hole 434 for pivotally securing the extremity rib means 2, and a pair of vertical side walls 430 parallelly formed on two opposite side surfaces of the pivoting means 43*a* for retarding two flat-side rib means 2*a* when folded as shown in FIG. 7.

The rib means 2, 2*a*, besides the top rib 21 and the stretcher rib 22, may include other ribs as shown in FIGS. 1, 2, 3, 12 for forming at least a foldable parallelogram linkage P which is secured with a folding spring 6 as hereinafter described. The position and structure of the folding spring 6 on the rib means 2, 2*a* may be varied or modified with respect to the specific rib assembly. However, the embodiment of the spring 6 as shown in FIGS. 2, 3 and 12 is the most preferred.

The rib means 2, 2*a* includes: a top rib 21 having an inner rib end 211 pivotally connected with a middle portion 224 of the stretcher rib 22; the stretcher rib 22 having an inner rib end 221 pivotally secured to the lower runner 4, and an outermost end 222 pivotally connected with a lower lug 241 of a middle joint 24; an intermediate rib 23 having an inner rib end 231 secured to the middle joint 24, and an outer rib end 232 pivotally connected with the rear rib 26; and an auxiliary connection rib 25 having an inner rib end 251 pivotally connected with an outer portion 213 of the top rib 21 adjacent to the outermost end 212 of the top rib 21 and having an outer rib end 252 pivotally connected with an inner portion 242 of the middle joint 24, thereby forming a foldable parallelogram linkage P by the top rib 21, the stretcher rib 22, the middle joint 24 secured with the intermediate rib 23, and the auxiliary connection rib 25 for enhancing the folding and unfolding of the rib assembly for smoothly opening or closing the umbrella of the present invention. Other rib assemblies may be modified by those skilled in the art.

The folding spring 6 includes: an outer spring end 61 secured to a pin 222 of the middle joint 24 pivotally connected with the outermost end of the stretcher rib 22, an inner spring end 62 secured to the auxiliary connection rib 25, and a limiting sleeve 63, which may be selected from a coil or helical spring, fixed in an outer portion 223 of the stretcher rib 22 for limiting a middle portion of the folding spring 6.

The narrowing member 7 as shown in FIGS. 1, 3 and 8–11 includes: a central hole 70 formed in the narrowing member 7 for engaging the central shaft 1, a pair of U-shaped recesses 72 recessed in two opposite end portions of the narrowing member 7, a pair of guiding arm portions 71 bifurcated outwardly from each end portion of the narrowing member 7 to be disposed on two side portions of each U-shaped recess 72 with each guiding arm portion 71 generally parallel to a vertical side wall 330 of the pivoting means 33*a*, having a wedge portion 73 inclined upwardly and outwardly from an outer portion of each guiding arm portion 71 to be tangential to each outer retarding portion 342 of the biasing means 34 as shown in FIGS. 8, 11, whereby upon folding of an opening umbrella, each flat-side rib means 2*a* will be guided downwardly inwardly by the two wedge portions 73 formed on the pair of guiding arm portions 71 to be received into each U-shaped recess 72 in the narrowing member 7 adjacent to each pivoting means 33*a* for minimizing the folding volume and for eliminating the manual make-up action to bias the flat-side rib means 2*a* towards the pivoting means 33*a* at each extremity portion E of the upper notch 3.

When closing an umbrella from its opened state by lowering the lower runner 4, the rib means 2, 2*a* will be folded towards the central shaft 1 and each folding spring 6 secured on the parallelogram linkage P will be tensioned from FIG. 2 to FIG. 3 when folding the rib means 2, 2*a* to approximate the central shaft 1 to thereby store the spring energy of the spring 6. Further retraction movement of the rib means 2, 2*a* towards the shaft 1 will release the tension force of the spring 6 to resiliently "push" the rib means 2, 2*a* towards the shaft 1. The rib means 2, 2*a* will be continuously guided by the pair of guiding arm portions 71 of the narrowing member 7 to be retracted into the recesses 72 of the narrowing member 7 to limit each flat-side rib means 2*a* in the recess 72 and to biase the rib means 2*a* from an outside portion of the biasing means 34 to approximate the side wall 330 of each pivoting means 33*a* as shown in FIGS. 8, 11 and 5. Meanwhile, each stretcher rib 22 of the flat-side rib means 2*a* is also biased inwardly from an outside position of the biasing means 44 as guided by the narrowing member 7 to approximate the vertical side wall 430 of the pivoting means 43*a* on the runner 4, thereby automtically biasing the flat-side rib means 2*a* towards the extremity rib means 2 to form a folding rib arrangement having each extremity rib means 2 sandwiched in between two flat-side rib means 2*a* for minimizing the folding volume and for saving any manual make-up by an umbrella user.

When opening the umbrella by raising the lower runner 4 to extend the rib means 2, 2*a* outwardly upwardly, the two extremity rib means 2 will be extended to pull and tension the umbrella cloth 5 in order to fully extend the flat-side rib means 2*a*, and the two flat-side rib means 2*a* formed at each extremity portion E of the upper notch 3 and the lower runner 4 will be slid and guided outwardly from the two wedge portions 73 formed on the pair of guiding arm portions 71 at the narrowing member 7 for fully extending the rib means for opening the umbrella as shown in FIGS. 4 and 6.

Figure 3B:
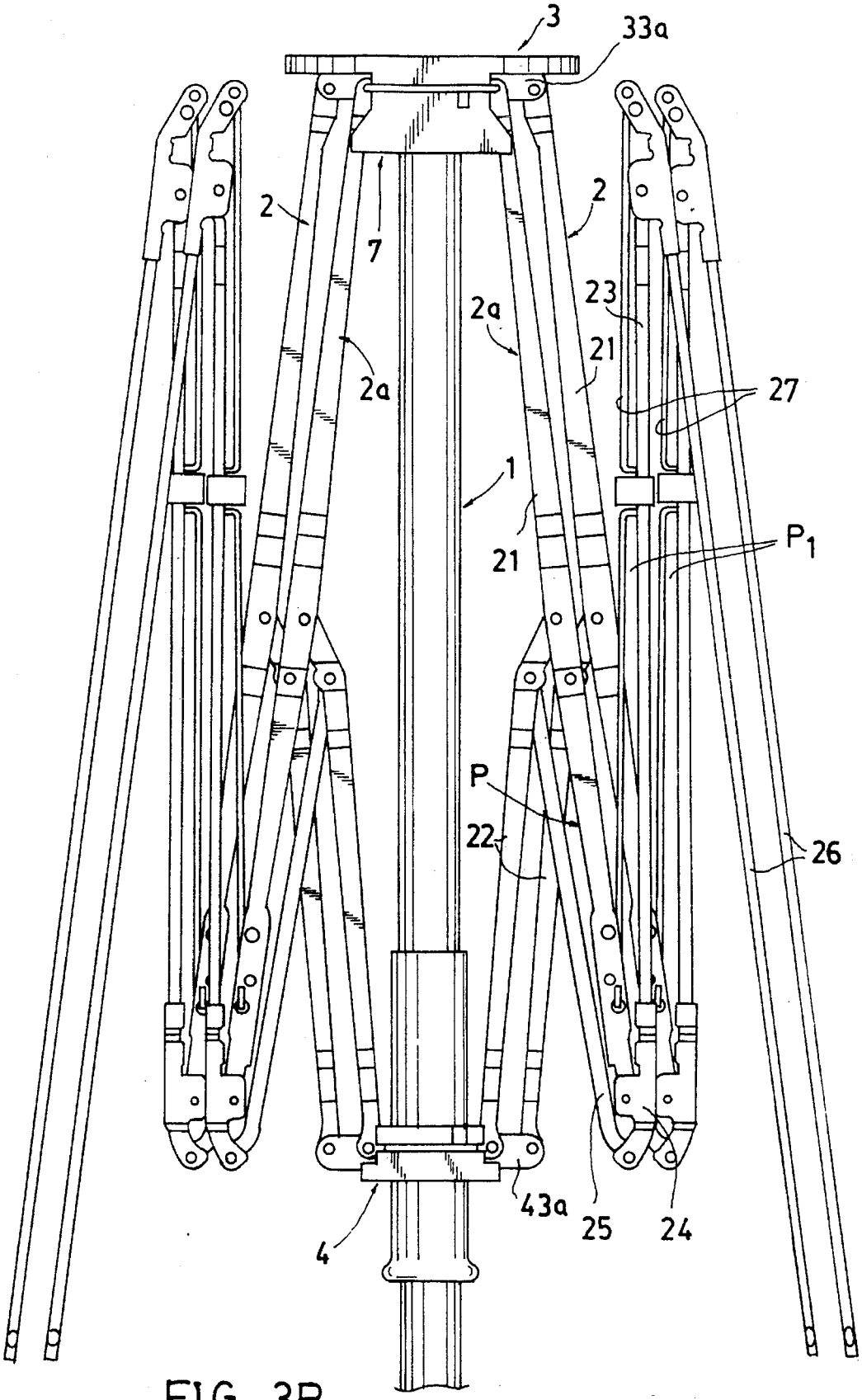
FIG. 3B shows a folded umbrella of another preferred embodiment of the present invention.

The present invention may be modified as shown in FIGS. 3B to include two parallelogram linkage sets P, P1, with the first linkage set P consisting of top rib 21, a stretcher rib 22, a middle joint 24 secured to an intermediate rib 23 and an auxiliary connection rib 25; and the second linkage set P1 consisting of the top rib 21, the intermediate rib 23, the rear rib 26 and a spring rib 27. Even though the folding springs 6 are omitted, the rib means are still retracted as guided by the narrowing member 7 to minimize the folding volume when closing the umbrella.

Figure 13:
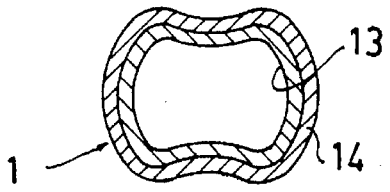
FIG. 13 is a cross sectional drawing of the central shaft of the present invention.
Figure 14:
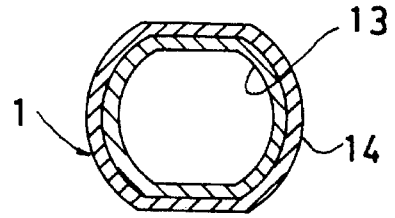
FIG. 14 shows another sectional drawing of the central shaft of the present invention.

As shown in FIGS. 13, 14, each shaft 1 may be formed by telescopically coupling at least an inner tube 13 and an outer tube 14, each tube being corrugated for preventing twisting during the telescopic operation of the shaft 1.

Figure 15:
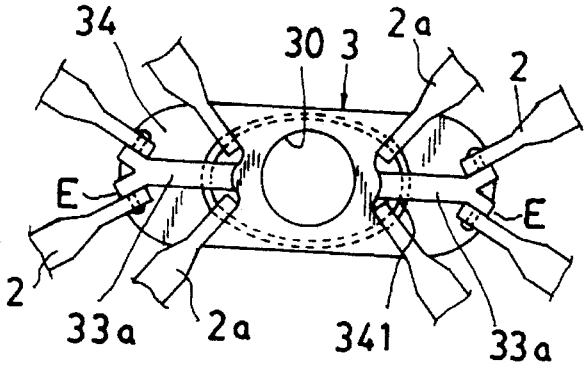
FIG. 15 shows a bottom view of the upper notch with eight sets of rib means of the present invention when opened.
Figure 16:
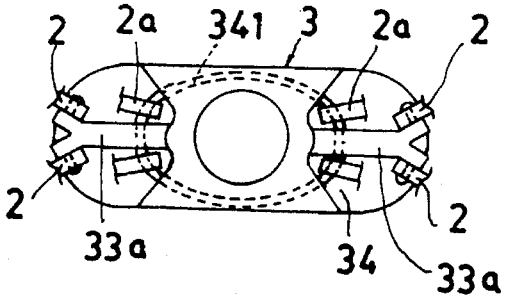
FIG. 16 is a bottom view of the upper notch of a folded umbrella as folded from FIG. 15.

As shown in FIGS. 15, 16, each pivoting means 33, 43 is pivotally connected with a pair of extremity rib means 2 for forming an umbrella having eight sets of rib means 2, 2*a* to become a further embodiment of the present invention.

The present invention is superior to the prior art with the following advantages:

1. As provided with the narrowing member 7, the ribs will be automatically guided and stored in each U-shaped recess 72 for saving any make-up action for manually biasing the ribs and umbrella cloth towards the extremity rib means 2.

2. The extremity rib means 2 as sandwiched between two flat-side rib means 2*a* will greatly minimize the folding volume of a folded umbrella for convenient portable purposes.

3. The folding spring on the parallelogram-linkage ribs will automatically help retraction of the rib means 2, 2*a* to save the manual make-up action in cooperation with the guiding and retraction by the narrowing member 7 when closing the umbrella.

4. The pivoting means 33*a*, 43*a* may be formed as a cassette member by reinforcing materials to increase its strength to prevent breakage for prolonging the service life of the umbrella, and to form a slim compact volume for each pivoting means 33*a*, 43*a* for minimizing a total folding volume when closing the umbrella.

5. Easier assembly and lower production cost can be achieved.

The present invention may be modified without departing from the spirit and scope of the present invention.

We claim:

1. A pocketable folding umbrella comprising:

an upper notch secured on an upper portion of a central shaft;

a lower runner slidably held on the central shaft and positioned under the upper notch:

two extremity rib means respectively pivotally secured on two extremity portions disposed on two opposite end portions of each said upper notch and said lower runner;

four flat-side rib means respectively pivotally secured to said upper notch and said lower runner, with each said flat-side rib means universally disposed in between each said extremity portion and a flat side portion of each said upper notch and said lower runner;

an umbrella cloth secured on said rib means;

a plurality of folding springs each secured to at least a foldable parallelogram linkage of each said rib means for resiliently retracting the rib means when closing the umbrella; and a narrowing member formed below said upper notch and having a pair of U-shaped recesses recessed in two opposite end portions of the narrowing member for guiding each said flat-side rib means into each said U-shaped recess to allow each said extremity rib means to be sandwiched in between two said flat-side rib means for minimizing a folding volume of the umbrella when closed from an opening state.

2. A folding umbrella according to claim 1, wherein said upper notch includes: an upper slim plate defining a long axis between two extremity portions disposed on two opposite ends of the slim plate and a short axis between two flat side portions of the slim plate to be perpendicular to the long axis, two pivoting means secured on two opposite extremity portions of the slim plate for radially pivotally securing a top rib of each said extremity rib means, and four biasing means each formed on the upper slim plate between each said flat side portion and each said pivoting means for universally pivotally securing each said top rib of each said flat-side rib means; said upper slim plate having said narrowing member formed thereunder.

3. A folding umbrella according to claim 2, wherein each said biasing means includes: a pivot formed as a loop wound in an annular groove recessed in the upper slim plate for universally pivotally securing each said top rib of said extremity rib means, and an outer retarding portion protruding sidewardly from a central portion of the upper slim plate towards the flat side portion to define an angle between the flat side portion and the outer retarding portion for limiting each said flat-side rib means when opening the umbrella, with the flat-side rib means operatively biased and retracted by the narrowing member to be generally parallel to a vertical side wall of the pivoting means for minimizing a folding volume of a closed umbrella.

4. A folding umbrella according to claim 2, wherein each said pivoting means formed as a cassette member, including: an extension portion formed on a bottom portion of the pivoting means to be engaged with a groove recessed in the upper slim plate of the upper notch, an inner pivot hole formed in an inner portion of the pivoting means for passing a pivot of the biasing means for fastening the pivoting means on the upper notch, an outer pivot hole formed in an outer portion of the pivoting means for inserting an outer pivot through the outer pivot hole for pivotally securing the extremity rib means, and a pair of vertical side walls parallelly formed on two opposite side surfaces of the pivoting means for retarding two flat-side rib means when folded.

5. A folding umbrella according to claim 2, wherein said narrowing member includes: a central hole formed in the narrowing member for engaging the central shaft, a pair of U-shaped recesses recessed in two opposite end portions of the narrowing member, a pair of guiding arm portions bifurcated outwardly from each end portion of the narrowing member to be disposed on two side portions of each U-shaped recess with each said guiding arm portion generally parallel to a vertical side wall of the pivoting means, having a wedge portion inclined upwardly and outwardly from an outer portion of each guiding arm portion to be tangential to an outer retarding portion formed on the biasing means, whereby upon folding of an opening umbrella, each said flat-side rib means is guided downwardly inwardly by the two wedge portions formed on the pair of guiding arm portions to be received into each said U-shaped recess in the narrowing member adjacent to each said pivoting means for minimizing the folding volume.

6. A folding umbrella according to claim 1, wherein said lower runner includes: a sleeve slidably engageable with the central shaft, a lower slim plate defining a long axis between two extremity portions disposed on two opposite ends of the lower slim plate and a short axis between two flat side portions of the lower slim plate to be perpendicular to the long axis, two runner pivoting means respectively secured on two opposite extremity portions of the lower slim plate for radially pivotally securing a stretcher rib of each extremity rib means, and four runner biasing means each formed on the lower slim plate between each said flat side portion and each said runner pivoting means for universally pivotally securing the stretcher rib of each said flat-side rib means.

7. A folding umbrella according to claim 6, wherein each said runner biasing means includes: a pivot formed as a loop wound in an annular groove recessed in the lower slim plate for universally pivotally securing a stretcher rib of each said extremity rib means, and an outer retarding portion protruding sidewardly from a central portion of the lower slim plate towards the flat side portion to define an angle between the flat side portion and the outer retarding portion for limiting a flat-side rib means when opening the umbrella, with the flat-side rib means operatively biased and retracted by the narrowing member adjacent to the upper notch to be generally parallel to a vertical side wall of the runner pivoting means for minimizing a folding volume of a closed umbrella.

8. A folding umbrella according to claim 6, wherein each said runner pivoting means is formed as a cassette member, including: an extension portion formed on a bottom portion of the runner pivoting means to be engaged with a groove recessed in the lower slim plate of the lower runner, an inner pivot hole formed in an inner portion of the runner pivoting means for passing a pivot of the runner biasing means for fastening the runner pivoting means on the lower runner, an outer pivot hole formed in an outer portion of the runner pivoting means for inserting an outer pivot through the outer pivot hole for pivotally securing the extremity rib means, and a pair of vertical side walls parallelly formed on two opposite side surfaces of the runner pivoting means for retarding two flat-side rib means when folded.

9. A folding umbrella according to claim 1. wherein each said rib means includes: a top rib pivotally connected with the stretcher rib; the stretcher rib pivotally secured to the lower runner, and pivotally connected with a middle joint; an intermediate rib secured to the middle joint, and pivotally connected with a rear rib; and an auxiliary connection rib pivotally connected with the top rib and pivotally connected with the middle joint for forming a foldable parallelogram linkage by the top rib, the stretcher rib, the middle joint secured with the intermediate rib, and the auxiliary connection rib; and each said folding spring including: an outer spring end secured to a pin of the middle joint pivotally connected with an outermost end of the stretcher rib, an inner spring end secured to the auxiliary connection rib, and a limiting sleeve fixed in an outer portion of the stretcher rib for limiting a middle portion of the folding spring.

* * * * *